US011399605B2

(12) United States Patent
Ratigan

(10) Patent No.: US 11,399,605 B2
(45) Date of Patent: Aug. 2, 2022

(54) CONVERTIBLE RESCUE BACKPACK

(71) Applicant: Michael Ratigan, Elon, NC (US)

(72) Inventor: Michael Ratigan, Elon, NC (US)

( * ) Notice: Subject to any disclaimer, the term of this patent is extended or adjusted under 35 U.S.C. 154(b) by 0 days.

(21) Appl. No.: 17/132,021

(22) Filed: Dec. 23, 2020

(65) Prior Publication Data

US 2022/0192334 A1 Jun. 23, 2022

(51) Int. Cl.

| | |
|---|---|
| ***A45C 7/00*** | (2006.01) |
| ***A45F 3/04*** | (2006.01) |
| ***A63B 29/02*** | (2006.01) |
| ***A45F 4/02*** | (2006.01) |

(52) U.S. Cl.

CPC ..... *A45C 7/0095* (2013.01); *A45F 3/04* (2013.01); *A45F 4/02* (2013.01); *A63B 29/02* (2013.01); *A45C 2007/0004* (2013.01); *A45F 2004/023* (2013.01)

(58) Field of Classification Search

CPC ..... A45C 2007/0004; A45C 7/0095; A45F 2004/006; A45F 4/02

USPC ..... 224/578–580

See application file for complete search history.

(56) References Cited

U.S. PATENT DOCUMENTS

| | | | | |
|---|---|---|---|---|
| 5,934,527 | A * | 8/1999 | Von Neumann | A45C 7/0086 224/153 |
| 5,950,894 | A * | 9/1999 | Haber | A45F 3/04 224/627 |
| 7,254,841 | B1 * | 8/2007 | Nelson | A41D 13/0012 2/102 |
| 10,213,649 | B2 | 2/2019 | Norton | |
| 10,405,640 | B2 * | 9/2019 | Coleman | A45F 3/042 |
| 10,524,560 | B2 | 1/2020 | Hanson et al. | |
| 11,219,800 | B1 * | 1/2022 | Ratigan | F16L 57/06 |
| 2006/0105137 | A1 * | 5/2006 | Kouts | A45C 7/0095 428/99 |
| 2006/0256546 | A1 * | 11/2006 | Amaral | A45C 7/0063 362/103 |
| 2010/0102098 | A1 * | 4/2010 | Stewart | A45F 3/14 224/258 |
| 2015/0343736 | A1 | 12/2015 | Kawka et al. | |
| 2018/0066921 | A1 | 3/2018 | Wagner et al. | |
| 2018/0235352 | A1 | 8/2018 | Jones et al. | |

(Continued)

FOREIGN PATENT DOCUMENTS

| | | | | |
|---|---|---|---|---|
| GB | 2537412 A | * 10/2016 | | A45F 4/02 |
| WO | WO-03094658 A1 | * 11/2003 | | A45F 4/02 |

OTHER PUBLICATIONS

Webpage printout showing Ultra-Pro TM Edge Protectors as sold by CMC Pro, print date Jul. 30, 2020.

(Continued)

*Primary Examiner* — Scott T McNurlen

(74) *Attorney, Agent, or Firm* — Tuggle Duggins P.A.; Blake P. Hurt

(57) ABSTRACT

A convertible backpack that can be used as an edge protection mat to protect ropes against abrasion and includes a flexible mat or sheet that can be configured into a pack and carried on the back of a user to carry equipment, clothing, or other gear. A pair of rope protection members are affixed to the outer surface of the sheet for carrying the pack and are easily removable for use alone or in combination with the flexible sheet to further protect ropes.

36 Claims, 6 Drawing Sheets

(56) References Cited

U.S. PATENT DOCUMENTS

2019/0077577 A1* 3/2019 Brandes ..... F25D 27/00

OTHER PUBLICATIONS

Webpage printout from Amazon showing P68 Set Caterpillar Articulated Protector sold by Petzl America, print date Jul. 30, 2020.
Webpage printout from safewaze.com showing SafeWaze Rope Protector, print date Jul. 30, 2020.
Webpage printout from ropesafeusa.com showing Ropesafe Edge Protection System, copyright RopeSafe Edge Protection System 2020.
Webpage printout from rescuetech1.com showing RescueTECH Rope Guard, copyright 2003, 2004, 2005, 2006, 2007, 2008, 2009, 2010 Rescue Technology / Technical Rope Rescue Equipment.
International Search Report from co-pending PCT/US2021/072748, dated Feb. 23, 2022.

* cited by examiner

CONVERTIBLE RESCUE BACKPACK

FIELD OF THE INVENTION

The invention herein pertains to a backpack generally, and particularly pertains to a convertible backpack that can be used for rigging and rescue operations to protect climbing ropes and/or as a load-bearing anchor point.

DESCRIPTION OF THE PRIOR ART AND OBJECTIVES OF THE INVENTION

Firefighters, rescue workers, police, roofers, window washers and many other professionals rely on ropes to safely perform their duties. Military personnel and civilians also use ropes to ascend or descend from cliffs, ledges, rooftops, etc. In these and other uses, the ropes are required to pass over rocks, railings, window ledges, edges of buildings and other locations where the fibers of the rope can become abraded, which compromises the load bearing capabilities of the rope and the safety of the user. To protect the ropes from such abrasion, it is known to place something between the rope and the adjacent structure. The Ultra-Pro™ Edge Protector sold by CMC Pro is semi-rigid molded plastic sheet that has a plurality of channels formed along the longitudinal axis of the sheet. The channels allow the ropes to be maintained in spaced-apart relation when the device is in use. The sheet is flexible at least along the longitudinal axis and can conform to the edge of a building. The device is said to reduce friction on the ropes and to soften the bend radius of the rope. Similar devices are sold by Seattle Manufacturing Corporation under the brand names "FLEX" and "Rope Tracker."

Another type of device, known as an articulated edge protector, comprises a series of roller modules. Each module has a roller supported by a frame that acts as a standoff to elevate the roller from an adjacent surface. The roller modules may be linked together to form a flexible articulated chain which is then placed over an edge of a structure. The rope is then placed atop the rollers. An example of such a device is the P68 Set Caterpillar Articulated Protector sold by Petzl America.

Yet another type of rope protection device is a flexible mat made from abrasion-resistant materials that can be placed between the rope and an adjacent structure. The mat can be used flat or wrapped around the rope and secured to form a protective sleeve. Numerous such devices are commercially available, such as the SafeWaze Rope Protector, RopeSafe and RescueTECH Rope Guard. One such mat, as taught in U.S. Pat. No. 10,213,649 (the entire disclosure of which is incorporated herein by reference) can also be attached to the rope and be repositioned along the rope by the user. The mat includes a handle used to carry the mat and facilitate repositioning the mat during use and can also be used as a load bearing member. U.S. Pat. No. 10,524,560 teaches a rollable backpack device for use with rigging equipment and rescue operations. The backpack has a plurality of "daisy chain" loops attached to one surface of a foldable and rollable mat. Equipment may be attached to the series of loops and then the sides and bottom of the mat folded inward to enclose the equipment. A pair of straps are affixed to the mat to permit carrying of the mat as a backpack. The entire disclosure of the aforementioned U.S. Pat. No. 10,524,560 is incorporated herein by reference.

Thus, in view of the problems and disadvantages associated with prior art devices, the present invention was conceived and one of its objectives is to provide a convertible rescue backpack which easily converts from a durable carrying pack to a rope protection system.

It is another objective of the present invention to provide a rope protection system that has functionality to protect ropes from abrasion.

It is still another objective of the present invention to provide a rope protection system that incorporates visual safety indicators.

It is yet another objective of the present invention to provide a rope protection system that is useful as a load-bearing support.

It is a further objective of the present invention to provide a rope protection system that can be used as a bag such as a backpack to carry additional equipment and gear.

It is still a further objective of the present invention to provide a rope protection system for adequately protecting a variety of rope segments in various environment.

It is yet a further objective of the present invention to provide a rope protection system comprising an edge protection mat foldable for use as a carrying pack and a pair of rope protection members affixable thereto to act as shoulder straps.

Various other objectives and advantages of the present invention will become apparent to those skilled in the art as a more detailed description is set forth below.

SUMMARY OF THE INVENTION

The aforesaid and other objectives are realized by providing a convertible backpack formed from an edge protection flexible mat or sheet that can be configured into a bag or pack and carried, for example on the back of a user, with straps formed from rope protection members. The flexible sheet is an edge protection mat and has an inner surface and an outer surface with one or more intermediate layers between the inner and outer surfaces. The flexible sheet has a cruciferous form when laid flat and has a top section, a front section positioned between two opposing side sections, and a tail section comprising a bottom section and a back section. The side sections can be folded inward to form the sides of a box-like structure and the tail section folded inward to form the bottom and back of the box-like structure. The side sections can be secured to the tail section to maintain the shape of the box-like structure, which can then be used to carry equipment, clothing, or other gear. The top section can be folded over to serve as a cover for the box-like assembly. A pair of shoulder straps are affixed to the outer surface of the front section to facilitate carrying of the box-like assembly on the back. In the preferred mode, the shoulder straps are removably attached to the front section of the flexible sheet and comprise rope protection members. The rope protection members are each a flexible sheet having an inner surface and an outer surface, two opposed lateral edges and two opposed longitudinal edges. A hanging loop is affixed to each lateral edge and a pair of spaced-apart loops are affixed to the inner surface. The rope protection sheet can be wrapped in a sleeve-like configuration about a rope and secured in place with a pair of spaced-apart straps, each located proximate a respective lateral edge of the mat and/or a mating fastener member on longitudinal edges of the sleeve.

DETAILED DESCRIPTION OF THE PREFERRED EMBODIMENT AND OPERATION OF THE INVENTION

Figure 1:
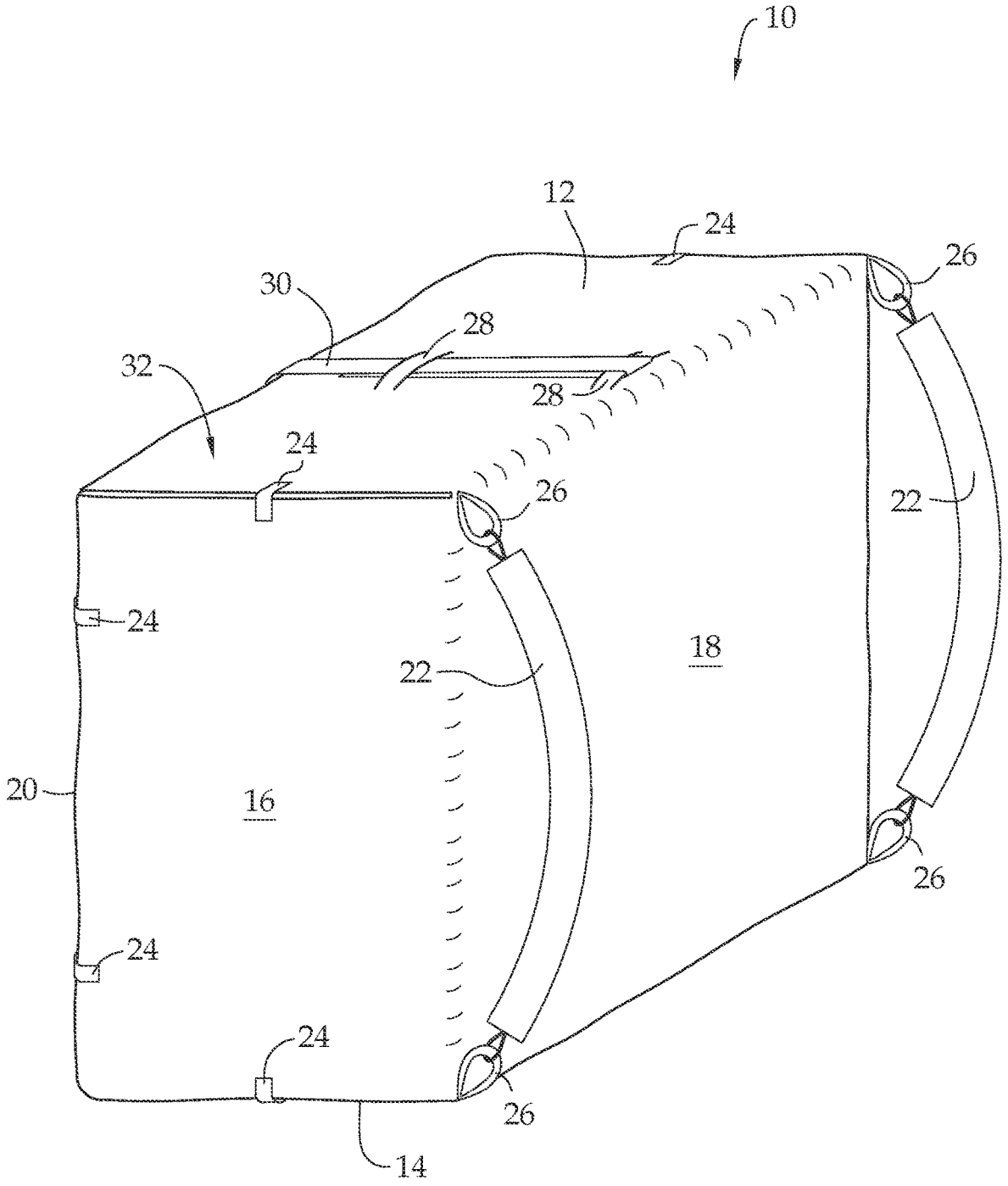
FIG. 1 shows a perspective view of an embodiment of the convertible rescue backpack illustrating the backpack in an assembled configuration.

Various exemplary embodiments of the present disclosure are described below. Use of the term "exemplary" means illustrative or buy way of example only, and any reference herein to "the invention" is not intended to restrict or limit the invention to exact features or step of any one or more of the exemplary embodiments disclosed in the present specification. References to "exemplary embodiment", "one embodiment", "an embodiment", "various embodiments", and the like may indicate that the embodiment(s) of the invention so described may include a particular feature, structure, or characteristic, but not every embodiment necessarily incudes the particular feature, structure, or characteristic. Further, repeated use of the phrase "in one embodiment", "in an exemplary embodiment", or "in an alternative embodiment" do not necessarily refer to the same embodiment, although they may.

It is also noted that terms like "preferably", "commonly", and "typically" are not utilized herein to limit the scope of the invention or to imply that certain features are critical, essential, or even important to the structure or function of the invention. Rather, these terms are merely intended to highlight alternative or additional features that may or may not be utilized in a particular embodiment of the present invention.

The present invention is described more fully hereinafter with reference to the accompanying figures, in which one or more exemplary embodiments of the invention are shown. Like numbers used herein refer to like elements throughout. The invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limited as to the scope of the invention, and any and all equivalents thereof. Moreover, many embodiments such as adaptations, variations, modifications, and equivalent arrangements will be implicitly disclosed by the embodiments described herein and fall within the scope of the instant invention.

Although specific terms are employed herein, they are used in a generic and descriptive sense only and not for the purposes of limitation. Unless otherwise expressly defined herein, such terms are intended to be given their broad, ordinary, and customary meaning not inconsistent with that applicable in the relevant industry ad without restriction to any specific embodiment hereinafter described. As used herein, the article "a" is intended to include one or more items. Where only one item is intended, the terms "one and only one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has previously been reduced to practice or that any testing has been performed. Likewise, unless stated otherwise, use of verbs in the past tense (present perfect or preterit) is not intended to indicate or imply that the invention has previously been reduced to practice or that any testing has been performed.

For a better understanding of the invention and its operation, turning now to the drawings, FIGS. 1-6 show a preferred convertible rescue backpack which is primarily useful as a device for protecting a climbing rope but can be folded into a box-like structure to facilitate transport of items such as clothing, rope, climbing accessories, or other gear and carried like a backpack. As used throughout, the term "backpack" is used to describe the assembled configuration of the preferred embodiment of the instant invention, owing mostly to its overall appearance. However, the term "backpack" is considered exemplary as used herein, and is not intended to be construed as a limitation on the instant invention. Embodiments of the instant invention, referred to collectively as a "backpack", may additionally include configurations resembling totes, duffel bags, suitcases, fanny packs, gunny sacks, and the like, and all are considered within the scope of the instant invention unless expressly indicated otherwise.

Figure 2:
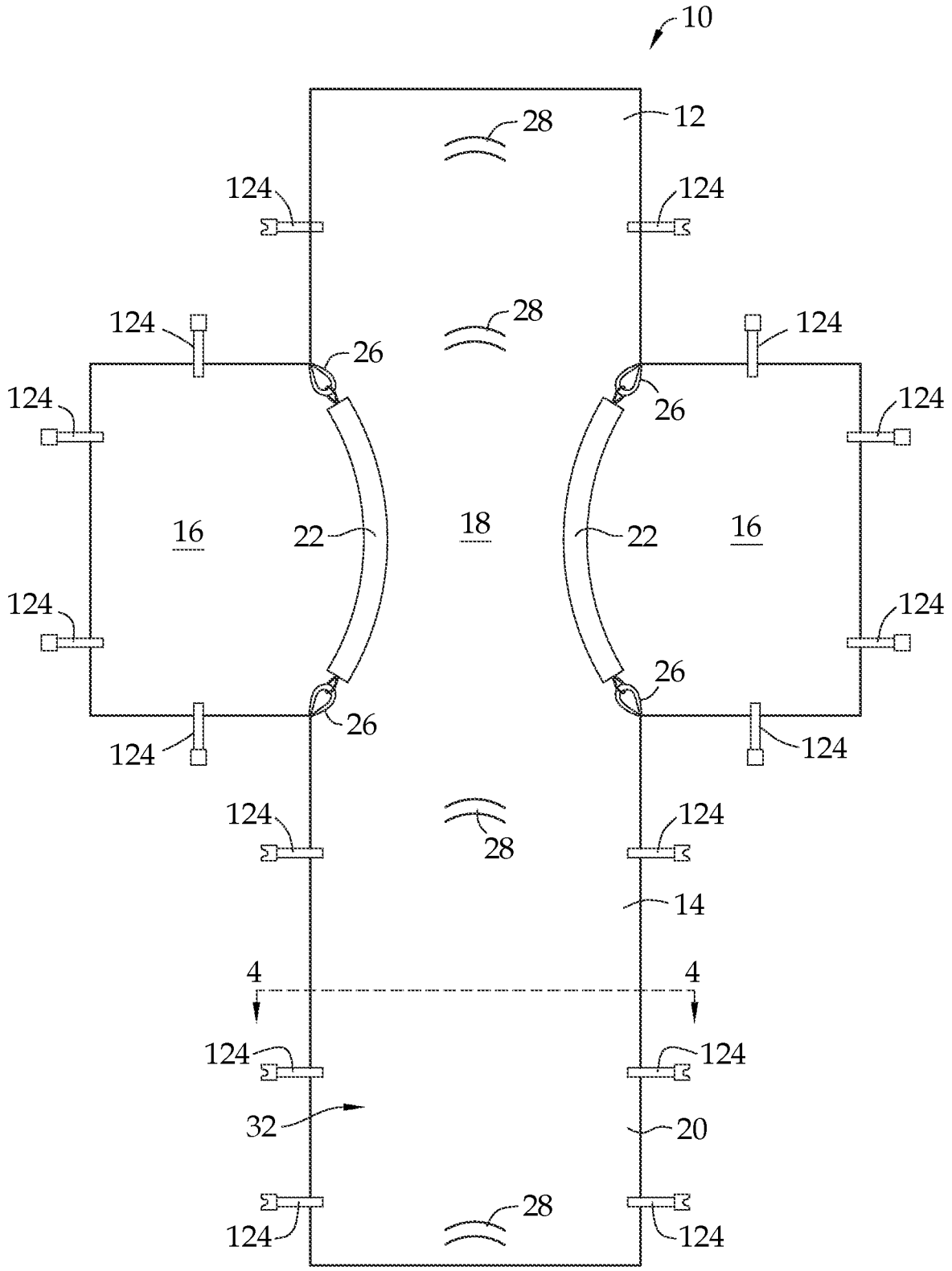
FIG. 2 depicts a plan view of the outside surface of the rescue backpack when opened and unfolded.

FIG. 1 illustrates the convertible rescue backpack 10 in a closed or assembled configuration that may preferably define a box-like configuration. FIG. 2 reflects an open configuration showing top section 12, front section 18 positioned between two opposing side sections 16, 16 (only one side is shown in FIG. 1), bottom section 14, and back section 20. A pair of shoulder straps 22, 22 are attached to the front section 18. The box-like shape of the backpack is preferably maintained by fastening the back section 20 to the opposing side sections 16 and fastening the bottom section 14 to the opposing side sections 16 by, for example, a plurality of fasteners 24. In the embodiment shown in FIG. 1, fasteners 24 comprise hook and loop type fastener straps. One or more embodiment of backpack 10 may be glued, sewn, or otherwise affixed in such a manner that fasteners of the type depicted as fasteners 24 are not necessary to form backpack 10. Other types of fasteners are possible, including those described below in connection with the discussion of the other figures, as well as simple strips of fabric that can be knotted together, and other closure means known in the art. Additionally, or in the alternative, one or more embodiments of backpack 10 may further include an internal reinforcement member to structurally reinforce the box-like configuration of backpack 10 when assembled. Such an internal reinforcement member may be forced from foam, cardboard, one or more rigid and/or semi-rigid polymer(s), or any other desirable material that is structurally robust and lightweight.

In the embodiment of FIG. 1, preferred shoulder straps 22 are attached to strap loops 26 which are attached proximate the corners of the front section 18 of the backpack 10. The attachment of the shoulder straps 22 may be accomplished with cordage, carabiners, buckles, clips, etc. (this list is not exhaustive, and should be construed to include both permanently affixed [i.e. required to be destroyed in order to remove] and non-permanently affixed [i.e. capable of being removed/reattached without destroying] species of attachment members). It is preferred that the shoulder straps 22 are defined as rope edge protection members, as described more fully below. Accordingly, it is preferred that the shoulder straps 22 be readily detachable from the strap loops 26. The top, front, bottom, and back sections of the backpack 10 may each include one or more anchor loops 28 to secure an anchor strap 30 around the backpack 10, as also seen in FIG. 2.

Figure 3:
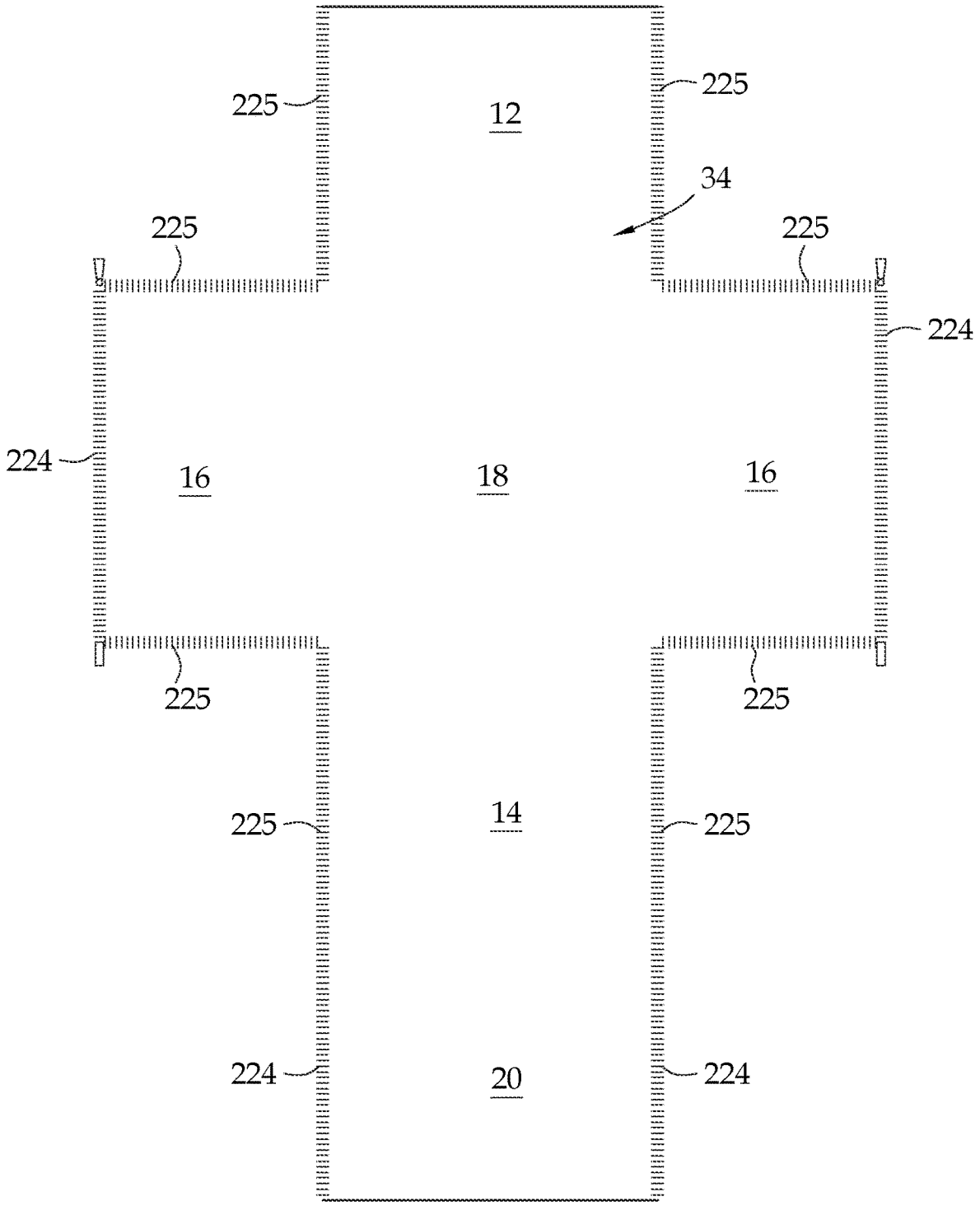
FIG. 3 pictures a plan view of the inside surface of the rescue backpack when opened and unfolded.

With reference now being made to FIGS. 2 and 3, the backpack 10 is illustrated in an open and unfolded condition, with FIG. 2 illustrating the outside or exterior surfaces 32 of the pack 10 and FIG. 3 illustrating the inside or interior surfaces 34 of the pack 10. As seen in FIGS. 2 and 3, when open and unfolded, the backpack 10 has a cruciferous or "t" shape with the top section 12, front section 18, bottom section 14, and back section 20 linearly arranged to form the long leg of the "t" and the side sections 16, 16 and front section 18 forming the short leg of the "t". In the embodiment of FIG. 2, a plurality of straps 124 are affixed to the side sections 16, each strap 124 having a mating half of a buckle attached thereto. The straps 124 can be used to secure the side sections 16 to the back section 20 and the bottom section 14 when the backpack is folded into the preferred box-like structure. In the embodiment shown in FIG. 3, a plurality of zippers 224 and 225 are employed as the fastener to secure the side sections, bottom section and back section into the preferred box-like structure. In this embodiment, the zippers 224 are used to secure the side sections 16 to the back section 20 and the zippers 225 are used to secure the bottom of side sections 16 to the bottom section 14. Other arrangements are possible.

When the backpack is in the open and unfolded condition as shown in FIGS. 2 and 3, it is advantageously designed to function as an edge protection mat to protect ropes that are used over the edge of a cliff, building or other structure that may abrade or otherwise damage the ropes and is intended to remain stationary during use. Anchor loops 28 on the front section 18 of the backpack may serve to anchor the edge protection mat in position. Each of anchor loops 28 may be a one to two (1-2) inch long loop, preferably made of nylon. The anchor loops 28 on the outer surface 32 of the pack (as seen in FIG. 2) allow the user to insert a preferred 1-inch anchor strap 30 under the anchor loops 28 to secure the backpack in the closed configuration during use. The anchor loops 28 are shown attached to the outside surface 32 of the pack but may also be provided on the inner surface 34 of the pack, as seen in FIG. 3, if desired, either in lieu of or in addition to the anchor loops 28 on the outside surface 32.

Figure 4:
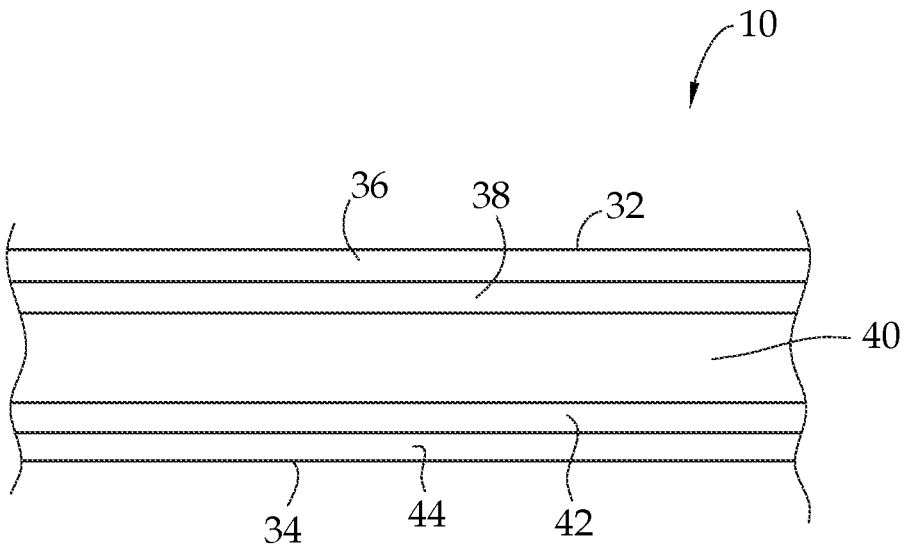
FIG. 4 is a schematic, fragmentary cross section view of the backpack as seen along line 4-4 of FIG. 2, illustrating the multi-layer construction.

An edge protection mat may be used to soften the bend modulus of the rope as it goes over the edge of a building or used underneath metal climbing gear to prevent them from being damaged by the building or rocks, etc. With particular reference to FIG. 4, a cross-section of the material used to fabricate the sections of the backpack is illustrated therein and shows the multi-layer construction. In preferred embodiments, the outermost layer 36 is made from a herringbone nylon weave ("HB nylon weave"), intermediate layer 38 is made of one thousand denier (1000D) ballistic nylon, middle layer 40 is made from a high loft, three-dimensional textile such as the HiFlow™ Spacer Fabrics from Highland Industries, intermediate layer 42 is made from 1000D ballistic nylon and inner most layer 44 is made from the aforementioned HB nylon weave. For more information on this spacer fabric, please see U.S. patent application Ser. No. 15/968,030, incorporated by reference in its entirety herein). In alternate embodiments where even more robust protection is desired, the outermost layer 36 and/or the inner layer 44 is made from 0.25 inch thick nylon webbing and intermediate layer 38 is made from 1680D ballistic nylon. Additional embodiments may have more, less, or different layers incorporated into the multi-layer construction as described above without departing from the scope of the instant invention. For example, for additional protection, a polymeric coating (not shown) may be applied atop the inner and/or outer layers 36 and/or 44. In one embodiment, this polymeric coating is defined as polyurethane, and more preferably as the polyurethane elastomer known as PureCast 603, commercially available from Industrial Polymer Corporation. For more information on this polymeric coating, please see U.S. patent application Ser. No. 15/420,320, incorporated by reference in its entirety herein).

Figure 5:
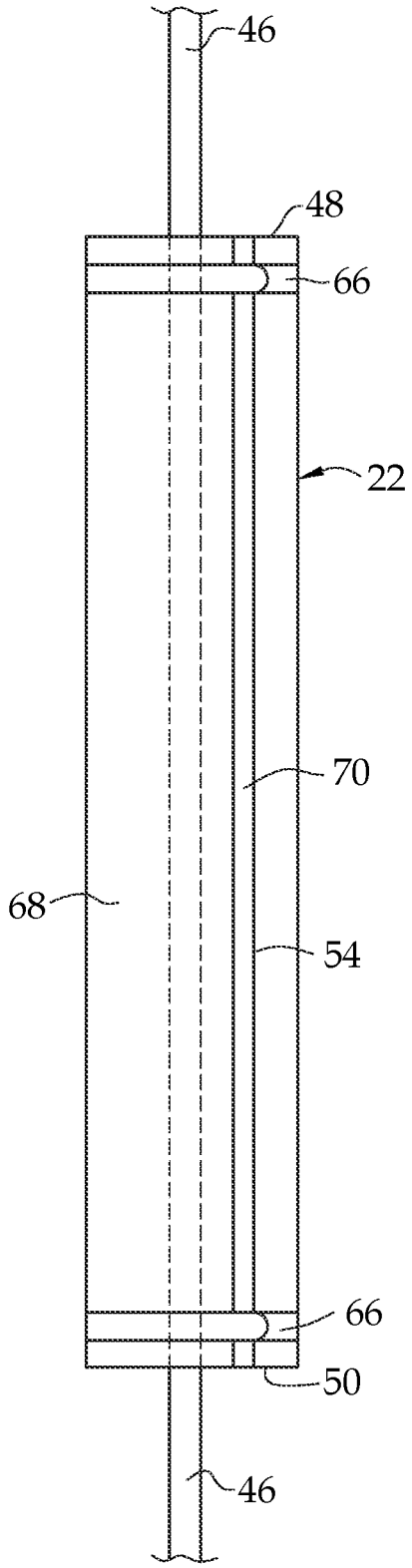
FIG. 5 demonstrates a plan view of a rope protection member, which in a preferred embodiment forms the shoulder strap for the backpack.

As mentioned above, in the preferred embodiment, the shoulder straps 22 are rope protection members. For more information on a rope protection member, please see U.S. patent application Ser. No. 17/076,334 which is incorporated by reference in its respective entirety herein. It is contemplated that, in use, the shoulder straps 22 would be detached from the backpack 10 and wrapped around, for example, the climbing rope 46 as seen in FIG. 5. The rope 46, wrapped in the shoulder strap 22, may then be placed atop the open and unfolded backpack 10, which would be placed adjacent to the building or other structure (not shown) being ascended or descended. Once the user is in position, the shoulder strap 22 could be moved along the rope 16 as the user descends or ascends the rope, if desired; alternatively the shoulder strap 22 may remain stationary.

Figure 6:
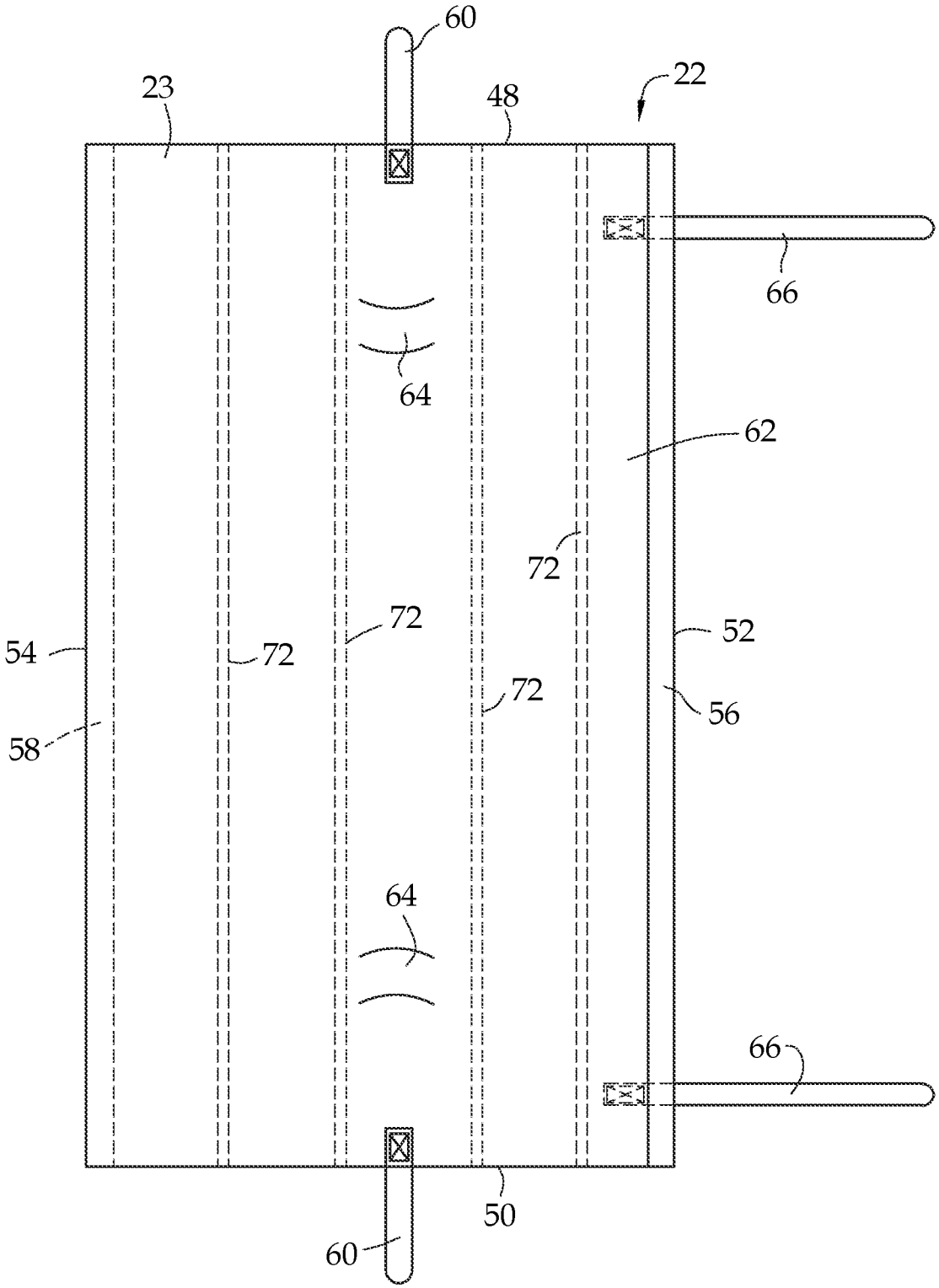
FIG. 6 features a plan view of the interior surface of the rope protection member of FIG. 5 shown in open configuration.

As can be seen in FIG. 6, the preferred shoulder strap 22 in its open position defines the configuration of a flexible mat 23 having a generally rectangular configuration with opposed lateral edges 48, 50 and opposed longitudinal edges 52, 54. Longitudinal edges 52 and 54 comprise a fastener including a first fastener component 56 and a second fastener component 58 (shown in phantom) enabling at least a portion of the length of the longitudinal edges 52 and 54 to be detachably attached to each other. The fastener components 56, 58 are preferably individual halves of a fastening tape that when used together allow closure for ease of use, although other closing mechanisms can be utilized as are known in the art for attaching and detaching at least a portion of the opposing edges 52 and 54 of the shoulder strap 22. Non-limiting examples of closure devices are buttons, snaps, zippers, hook and loop fasteners or magnetic fasteners. Shoulder strap 22 should be flexible enough to provide an opening large enough for a load bearing rope to pass through the opening created when the fastener halves 56, 58 are engaged and the edges 52, 54 are attached to each other such as seen in FIG. 5 with rope 46.

With continued reference to FIG. 6, a hanging loop 60 each approximately one to two (1-2) inches in length, is affixed to each of the lateral edges 48, 50 of the mat 23. These hanging loops 60 can be used to secure the mat 23 to the climbing rope 46 or to a stationary fixture (a tree, a structure on a building, etc.) to serve as an anchor point. The inner surface 62 of mat 23 includes a pair of spaced-apart belt loops 64, 64. These belt loops 64, 64 allow the user to insert a one (1) inch anchor strap 30 (see FIG. 1) under the loops, thus allowing the user to anchor the loop at the top side end and use the bottom end as a handle to assist the user getting into position before they descend down the building. The system can also be used as an anchor point and the climber hooking up the top loops on the anchor strap. A pair of spaced-apart closure straps 66, 66 are located proximate to and oriented parallel to the lateral edges 48, 50 of mat 23. When the mat 23 is in the closed position, as seen in FIG. 5, the closure straps 66, 66 wrap around the mat and maintain the mat 23 in a closed position. The closure straps 66, 66 may be used in addition to or in lieu of first and second fastener components 56, 58.

The outer face 68 (see FIG. 5) of the mat 23 is preferably made of HB nylon weave with the inner face 62 preferably made of 1000D ballistic nylon. The material used to make the outer face 68 is preferably a dark color, such as black, and the material used to make the inner face 62 is preferably a hi-vis color such as yellow, orange or lime green. The high color contrast between the layers 68, 62 is preferred as a visual safety indicator alerting the user that the outer layer has worn through, exposing the hi-vis layer. The term "high-visibility color" (or "hi-vis" for short) in this context is taken to include all high-visibility apparel embodiments as defined by ANSI/ISEA 107-2015, including Type O, Type R, and Type P embodiment types of Class 1, 2, 3, E, and Optional High-Visibility Accessory performance classes. The high color contrast between the layers 62, 68 is preferred as a visual safety indicator alerting the user that the outer layer has worn through, exposing the high-visibility layer. The outer face 68 is preferably provided with reflective material 70 along the peripheral edges (48, 50, 52, 54) as an additional visual safety indicator. As a further additional visual safety feature, the materials used for the inner face and outer face are preferably sewn together using reflective thread 72. An example of an acceptable reflective thread is the reflective thread offered commercially by Ki-Shin Corp. which is a 2000 denier, three filament thread with a tenacity of ~3800 cN. Tapes, appliques, and powered illumination sources may also be incorporated as desirable.

Similarly, reflective trim and reflective thread may be used in formation of the cruciferous shaped mat used to fabricate the backpack. In addition, it is preferred that intermediate layers 38 and 42 be of contrasting color compared to outer layers 36 and 44 as further visual safety indicators. The reason is that as the external layers 36, 44 begin to wear, the high contrast color will begin to telegraph through and alert the user that the protection afforded by the mat has been compromised. Additional embodiments may have more, less, or different layers incorporated into the multi-layer construction as described above without departing from the scope of the instant invention. For example, for additional protection, a polymeric coating (not shown) may be applied atop the inner and/or outer faces 62 and/or 68. In one embodiment, this polymeric coating is defined as polyurethane, and more preferably as the polyurethane elastomer known as PureCast 603, commercially available from Industrial Polymer Corporation.

The illustrations and examples provided herein are for explanatory purposes and are not intended to limit the scope of the appended claims and while specific terms have been employed, they are used in a generic and descriptive sense only. For example, the dimensions of the backpack are not particularly important, and the pack can be made to any desired size. Moreover, while the preferred shape of the backpack is that of a box, as shown, the invention is not to be limited to any particular shape or configuration. Similarly, attachment points, such as individual loops or a series of daisy chain loops may be added to the interior or exterior surface of the pack as desired for specific applications. As noted above, the long anchor strap may be repositioned and attached at the respective ends of one or more embodiments of backpack 10 so as to deploy the pack as a duffle bag (it being understood and more, less, or different hardware may be useful in this configuration that is not otherwise shown). Ultimately, it should be understood that a backpack constructed in this manner will produce a relatively "soft" structure (relative to harder goods, as measured by Shore A, known in the art) that defines a sufficiently high coefficient of abrasion resistance to protect one or more ropes for an extended period of time. At the present time, there is relatively little in the way of standardized abrasion testing, but the Taber Test is one such measurement wherein applicant's backpack demonstrates statistically significant abrasion resistance relative to the prior art. Various other modifications and alternatives that may suggest themselves to those skilled in the art upon reading the foregoing disclosure are intended to be considered within the scope of the invention.

I claim:

1. A convertible backpack comprising a sheet with one or more fasteners on one or more peripheral edges thereof, the sheet configured to be folded and adjacent peripheral edges secured together to form a structure defining an interior cavity; and a pair of shoulder straps affixed to an outside surface of the sheet to facilitate transport of the sheet by a user, wherein the sheet defines a multiple-layer construction including an inside surface layer, a first intermediate layer adjacent the inside surface layer, a middle layer adjacent the first intermediate layer, a second intermediate layer adjacent the middle layer, and an outside surface layer; wherein at least one of the intermediate layers comprises a hi-vis color material and the outside surface layer comprises a high contrast color material.

2. The convertible backpack of claim 1, wherein the sheet further comprises reflective strips on at least one of the peripheral edges of the sheet.

3. The convertible backpack of claim 1, wherein the second intermediate layer comprises a hi-vis color material, wherein the sheet further comprises reflective strips on at least one of the peripheral edges and wherein the multiple layers are secured together with reflective stitching.

4. The convertible backpack of claim 1, wherein the second intermediate layer comprises a hi-vis color material, wherein the sheet further comprises reflective strips on at least one of the peripheral edges; wherein the multiple layers are secured together with reflective stitching; and wherein the middle layer comprises a high loft, three-dimensional textile.

5. The convertible backpack of claim 1, wherein the second intermediate layer comprises a hi-vis color material, wherein the sheet further comprises reflective strips on at least one of the peripheral edges; wherein the multiple layers are secured together with reflective stitching; wherein the inside surface layer is defined as a nylon material woven in a herringbone pattern; wherein the first intermediate layer is a one thousand denier (1000D) nylon material; wherein the middle layer is a high loft, three-dimensional textile; wherein the second intermediate layer is selected from a 1000D nylon material and a 1680D nylon material; and wherein the outside surface layer is selected from a nylon material woven in a herringbone pattern and 0.25 inch thick nylon webbing.

6. The convertible backpack of claim 1, wherein the second intermediate layer comprises a hi-vis color material, wherein the sheet further comprises reflective strips on at least one of the peripheral edges and wherein the multiple layers are secured together with reflective stitching; wherein the inside surface layer is a nylon material woven in a herringbone pattern; wherein the first intermediate layer is a 1000D nylon material; wherein the middle layer is a high loft, three-dimensional textile; wherein the second intermediate layer is selected from a 1000D nylon material and a 1680D nylon material; and wherein the outside surface layer is selected from a nylon material woven in a herringbone pattern and 0.25 inch thick nylon webbing; wherein the sheet further comprises a plurality of strap loops secured on an outside surface of the sheet, the strap loops defining attachment points for the pair of shoulder straps; and a pair of spaced apart anchor loops on at least one of the inside and outside surfaces of the sheet for securing an anchor strap.

7. The convertible backpack of claim 1, wherein the sheet defines a cruciferous shape comprising a rectangular front section, a top section attached to the front section, a pair of opposed side sections attached to opposite edges of the front section and an elongated tail section attached to the front section, wherein the elongated tail section is configured to be folded upward and inward to form a bottom section and a back section of a box-like structure; wherein the pair of opposed side sections are each configured to be folded inward to form sides of the box-like structure; wherein the top section is configured to be folded inward to form a lid of the box-like structure; and wherein the opposing side sections and the elongated tail section further comprise fasteners to secure the side sections, back section, and bottom section of the box-like structure together.

8. The convertible backpack of claim 1, wherein the sheet defines a cruciferous shape comprising a rectangular front section, a top section attached to the front section, a pair of opposed side sections attached to opposite edges of the front section and an elongated tail section attached to the front section, wherein the elongated tail section is configured to be folded upward and inward to form a bottom section and a back section of a box-like structure; wherein the pair of opposed side sections are each configured to be folded inward to form sides of the box-like structure; wherein the top section is configured to be folded inward to form a lid of the box-like structure; and wherein the opposing side sections and the elongated tail section further comprise fasteners to secure the side sections, back section, and bottom section of the box-like structure together, the fasteners selected from hook and loop fasteners, buckles, and zippers.

9. The convertible backpack of claim 1, wherein the pair of shoulder straps are removable from the sheet and wherein each of the pair of shoulder straps form a rope protection mat comprising a flat, rectangular sheet including an inside surface, an outside surface, a pair of opposed longitudinal edges, a pair of opposed lateral edges, and a visual safety indicator; the rope protection mat including fasteners to maintain the rope protection mat in a rolled configuration about a climbing rope; and wherein the visual safety indicator on the rope protection mat comprises reflective strips at the longitudinal and lateral edges on the outside surface of the rope protection mat.

10. The convertible backpack of claim 1, wherein the pair of shoulder straps are removable from the sheet and wherein each of the pair of shoulder straps comprises a rope protection mat comprising a flat, rectangular sheet including an inside surface, an outside surface, a pair of opposed longitudinal edges and a pair of opposed lateral edges; the rope protection mat having straps located proximate the opposed lateral edges to maintain the rope protection mat in a rolled configuration about a climbing rope.

11. The convertible backpack of claim 1, wherein the pair of shoulder straps are removable from the sheet and wherein each of the pair of shoulder straps comprises a rope protection mat comprising a flat, rectangular sheet including an inside surface, an outside surface, a pair of opposed longitudinal edges, a pair of opposed lateral edges, and a visual safety indicator; the rope protection mat including straps located proximate the opposed lateral edges to maintain the rope protection mat in a rolled configuration about a climbing rope; and wherein the visual safety indicator on the rope protection mat comprises reflective strips at the longitudinal and lateral edges on the outside surface of the rope protection mat and on the straps.

12. The convertible backpack of claim 1, wherein the pair of shoulder straps are removable from the sheet and wherein each of the pair of shoulder straps comprises a rope protection mat comprising a flat, rectangular sheet including an inside surface, an outside surface, a pair of opposed longitudinal edges and a pair of opposed lateral edges; the rope protection mat including mating fasteners on the opposed longitudinal edges to maintain the rope protection mat in a rolled configuration about a climbing rope.

13. The convertible backpack of claim 1, wherein the pair of shoulder straps are removable from the sheet and wherein each of the pair of shoulder straps comprises a rope protection mat comprising a flat, rectangular sheet including an inside surface, an outside surface, a pair of opposed longitudinal edges and a pair of opposed lateral edges; the rope protection mat including mating fasteners on the opposed longitudinal edges to maintain the rope protection mat in a rolled configuration about a climbing rope; the mating fasteners selected from hook and loop fasteners, zipper, buttons and snaps.

14. The convertible backpack of claim 1, wherein the pair of shoulder straps are removable from the sheet and wherein each of the pair of shoulder straps comprises a rope protection mat comprising a flat, rectangular sheet including an inside surface made of a first material, an outside surface made of a second material, a pair of opposed longitudinal edges, a pair of opposed lateral edges, and a visual safety indicator; the rope protection mat including fasteners to maintain the rope protection mat in a rolled configuration about a climbing rope; and wherein the visual safety indicator on the rope protection mat comprises a hi-vis color material as the first material and a high contrast color material as the second material.

15. The convertible backpack of claim 1, wherein the pair of shoulder straps are removable from the sheet and wherein each of the pair of shoulder straps comprises a rope protection mat comprising a flat, rectangular sheet including an inside surface made of a first material, an outside surface made of a second material, a pair of opposed longitudinal edges, a pair of opposed lateral edges, and a visual safety indicator; the rope protection mat including fasteners to maintain the rope protection mat in a rolled configuration around a climbing rope; and wherein the visual safety indicator on the rope protection mat comprises reflective stitching securing the first material to the second material.

16. The convertible backpack of claim 1, wherein the pair of shoulder straps are removable from the sheet and wherein each of the pair of shoulder straps comprises a rope protection mat comprising a flat, rectangular sheet having an inside surface made of a first material, an outside surface made of a second material, a pair of opposed longitudinal edges, a pair of opposed lateral edges, and a visual safety indicator; the rope protection mat including fasteners to maintain the rope protection mat in a rolled configuration about a climbing rope; the first material comprising a one thousand denier (1000D) ballistic nylon in a hi-vis color; the second material comprising a nylon material woven in herringbone pattern and defining a dark color; and wherein the visual safety indicator on the rope protection mat comprises reflective strips at the longitudinal and lateral edges on the outside surface of the rope protection mat and on the straps in combination with the color contrast between the first material and the second material and reflective stitching securing the first material to the second material.

17. The convertible backpack of claim 1, wherein the pair of shoulder straps are removable from the sheet and wherein each of the pair of shoulder straps comprises a rope protection mat comprising a flat, rectangular sheet including an inside surface made of a first material, an outside surface made of a second material, a pair of opposed longitudinal edges, a pair of opposed lateral edges, and a visual safety indicator; the rope protection mat including fasteners to maintain the rope protection mat in a rolled configuration about a climbing rope; a hanging loop located at each of the opposed lateral edges; a pair of spaced-apart loops located on the inside surface; wherein the first material comprises a one thousand denier (1000D) ballistic nylon in a hi-vis color; wherein the second material comprises a nylon material woven in herringbone pattern and defining a dark color; and wherein the visual safety indicator on the rope protection mat comprises reflective strips at the longitudinal and lateral edges on the outside surface of the rope protection mat and on the straps in combination with the color contrast between the first material and the second material and reflective stitching securing the first material to the second material.

18. A convertible backpack comprising a sheet with one or more fasteners on one or more peripheral edges thereof, the sheet configured to be folded and adjacent peripheral edges secured together to form a structure defining an interior cavity; and a pair of shoulder straps affixed to an outside surface of the sheet to facilitate transport of the sheet by a user, wherein the pair of shoulder straps are removable from the sheet and wherein each of the pair of shoulder straps comprises a rope protection mat defined as a flat, rectangular sheet including an inside surface, an outside surface, a pair of opposed longitudinal edges and a pair of opposed lateral edges; the rope protection mat including mating fasteners on the opposed longitudinal edges to maintain the rope protection mat in a rolled configuration about a climbing rope.

19. The convertible backpack of claim 18, wherein the sheet defines a multiple-layer construction including an inside surface layer, an outside surface layer, and one or more intermediate layers between the inside surface layer and the outside surface layer.

20. The convertible backpack of claim 18, wherein the sheet defines a multiple-layer construction including an inside surface layer, a first intermediate layer adjacent the inside surface layer, a middle layer adjacent the first intermediate layer, a second intermediate layer adjacent the middle layer, and an outside surface layer.

21. The convertible backpack of claim 18, wherein the sheet further comprises reflective strips on at least one of the peripheral edges of the sheet.

22. The convertible backpack of claim 18, wherein the sheet defines a multiple-layer construction including an inside surface layer, a first intermediate layer adjacent the inside surface layer, a middle layer adjacent the first intermediate layer, a second intermediate layer adjacent the middle layer, and an outside surface layer; wherein the second intermediate layer comprises a hi-vis color material and the outside surface layer comprises a high contrast color material.

23. The convertible backpack of claim 18, wherein the sheet defines a multiple-layer construction including an inside surface layer, a first intermediate layer adjacent the inside surface layer, a middle layer adjacent the first intermediate layer, a second intermediate layer adjacent the middle layer, and an outside surface layer; wherein the second intermediate layer comprises a hi-vis color material and the outside surface layer comprises a high contrast color material, wherein the sheet further comprises reflective strips on at least one of the peripheral edges and wherein the multiple layers are secured together with reflective stitching.

24. The convertible backpack of claim 18, wherein the sheet defines a multiple-layer construction including an inside surface layer, a first intermediate layer adjacent the inside surface layer, a middle layer adjacent the first intermediate layer, a second intermediate layer adjacent the middle layer, and an outside surface layer; wherein the second intermediate layer comprises a hi-vis color material and the outside surface layer comprises a high contrast color material, wherein the sheet further comprises reflective strips on at least one of the peripheral edges; wherein the multiple layers are secured together with reflective stitching; and wherein the middle layer comprises a high loft, three-dimensional textile.

25. The convertible backpack of claim 18, wherein the sheet defines a multiple-layer construction including an inside surface layer, a first intermediate layer adjacent the inside surface layer, a middle layer adjacent the first intermediate layer, a second intermediate layer adjacent the middle layer, and an outside surface layer; wherein the second intermediate layer comprises a hi-vis color material and the outside surface layer comprises a high contrast color material, wherein the sheet further comprises reflective strips on at least one of the peripheral edges; wherein the multiple layers are secured together with reflective stitching; wherein the inside surface layer is defined as a nylon material woven in a herringbone pattern; wherein the first intermediate layer is a one thousand denier (1000D) nylon material; wherein the middle layer is a high loft, three-dimensional textile; wherein the second intermediate layer is selected from a 1000D nylon material and a 1680D nylon material; and wherein the outside surface layer is selected from a nylon material woven in a herringbone pattern and 0.25 inch thick nylon webbing.

26. The convertible backpack of claim 18, wherein the sheet defines a multiple-layer construction including an inside surface layer, a first intermediate layer adjacent the inside surface layer, a middle layer adjacent the first intermediate layer, a second intermediate layer adjacent the middle layer, and an outside surface layer; wherein the second intermediate layer comprises a hi-vis color material and the outside surface layer comprises a high contrast color material, wherein the sheet further comprises reflective strips on at least one of the peripheral edges and wherein the multiple layers are secured together with reflective stitching; wherein the inside surface layer is a nylon material woven in a herringbone pattern; wherein the first intermediate layer is a 1000D nylon material; wherein the middle layer is a high loft, three-dimensional textile; wherein the second intermediate layer is selected from a 1000D nylon material and a 1680D nylon material; and wherein the outside surface layer is selected from a nylon material woven in a herringbone pattern and 0.25 inch thick nylon webbing; wherein the sheet further comprises a plurality of strap loops secured on an outside surface of the sheet, the strap loops defining attachment points for the pair of shoulder straps; and a pair of spaced apart anchor loops on at least one of the inside and outside surfaces of the sheet for securing an anchor strap.

27. The convertible backpack of claim 18, wherein the sheet defines a cruciferous shape comprising a rectangular front section, a top section attached to the front section, a pair of opposed side sections attached to opposite edges of the front section and an elongated tail section attached to the front section, wherein the elongated tail section is configured to be folded upward and inward to form a bottom section and a back section of a box-like structure; wherein the pair of opposed side sections are each configured to be folded inward to form sides of the box-like structure; wherein the top section is configured to be folded inward to form a lid of the box-like structure; and wherein the opposing side sections and the elongated tail section further comprise fasteners to secure the side sections, back section, and bottom section of the box-like structure together.

28. The convertible backpack of claim 18, wherein the sheet defines a cruciferous shape comprising a rectangular front section, a top section attached to the front section, a pair of opposed side sections attached to opposite edges of the front section and an elongated tail section attached to the front section, wherein the elongated tail section is configured to be folded upward and inward to form a bottom section and a back section of a box-like structure; wherein the pair of opposed side sections are each configured to be folded inward to form sides of the box-like structure; wherein the top section is configured to be folded inward to form a lid of the box-like structure; and wherein the opposing side sections and the elongated tail section further comprise fasteners to secure the side sections, back section, and bottom section of the box-like structure together, the fasteners selected from hook and loop fasteners, buckles, and zippers.

29. The convertible backpack of claim 18, wherein the rope protection mat further includes a visual safety indicator; and wherein the visual safety indicator on the rope protection mat comprises reflective strips at the longitudinal and lateral edges on the outside surface of the rope protection mat.

30. The convertible backpack of claim 18, wherein the rope protection mat includes straps located proximate the opposed lateral edges to maintain the rope protection mat in a rolled configuration about a climbing rope.

31. The convertible backpack of claim 18, wherein the rope protection mat further comprises a visual safety indicator and straps located proximate the opposed lateral edges to maintain the rope protection mat in a rolled configuration about a climbing rope; and wherein the visual safety indicator on the rope protection mat comprises reflective strips at the longitudinal and lateral edges on the outside surface of the rope protection mat and on the straps.

32. The convertible backpack of claim 18, wherein the mating fasteners selected from hook and loop fasteners, zipper, buttons and snaps.

33. The convertible backpack of claim 18, wherein the rope protection mat further comprises the inside surface made of a first material, the outside surface made of a second material, and a visual safety indicator; and wherein the visual safety indicator on the rope protection mat comprises a hi-vis color material as the first material and a high contrast color material as the second material.

34. The convertible backpack of claim 18, wherein the rope protection mat further comprises the inside surface made of a first material, the outside surface made of a second material, and a visual safety indicator; and wherein the visual safety indicator on the rope protection mat comprises reflective stitching securing the first material to the second material.

35. The convertible backpack of claim 18, wherein the rope protection mat further comprises the inside surface made of a first material, the outside surface made of a second material, and a visual safety indicator; the first material comprising a one thousand denier (1000D) ballistic nylon in a hi-vis color; the second material comprising a nylon material woven in herringbone pattern and defining a dark color; and wherein the visual safety indicator on the rope protection mat comprises reflective strips at the longitudinal and lateral edges on the outside surface of the rope protection mat and on the straps in combination with the color contrast between the first material and the second material and reflective stitching securing the first material to the second material.

36. The convertible backpack of claim 18, wherein the rope protection mat further comprises the inside surface made of a first material, the outside surface made of a second material, a visual safety indicator; a hanging loop located at each of the opposed lateral edges; a pair of spaced-apart loops located on the inside surface; wherein the first material comprises a one thousand denier (1000D) ballistic nylon in a hi-vis color; wherein the second material comprises a nylon material woven in herringbone pattern and defining a dark color; and wherein the visual safety indicator on the rope protection mat comprises reflective strips at the longitudinal and lateral edges on the outside surface of the rope protection mat and on the straps in combination with the color contrast between the first material and the second material and reflective stitching securing the first material to the second material.

* * * * *